United States Patent [19]

Blum

[11] 4,143,993

[45] Mar. 13, 1979

[54] SUCTION PUMP WITH ROTATABLE FLOW RETAINING AND REPELLING ELEMENT

[76] Inventor: Albert Blum, Scheiderhöhe, 5204 Lohmar 1, Fed. Rep. of Germany

[21] Appl. No.: 746,801

[22] Filed: Dec. 2, 1976

[30] Foreign Application Priority Data

Mar. 26, 1976 [DE] Fed. Rep. of Germany ..... 2612910

[51] Int. Cl.[2] ..... F04D 7/04

[52] U.S. Cl. ..... 415/121 B; 241/46.06

[58] Field of Search ..... 241/46 R, 46.06, 46.11, 241/46.13, 46.17; 415/121 B

[56] References Cited

U.S. PATENT DOCUMENTS

| | | | |
|---|---|---|---|
| 619,675 | 2/1899 | Cram | 415/121 B |
| 3,560,106 | 2/1971 | Sahlstrom | 415/121 B |

FOREIGN PATENT DOCUMENTS

| | | | |
|---|---|---|---|
| 832549 | 1/1952 | Fed. Rep. of Germany | 415/121 B |
| 1176614 | 8/1964 | Fed. Rep. of Germany | 415/121 B |
| 2411043 | 9/1975 | Fed. Rep. of Germany | 415/121 B |

*Primary Examiner*—C. J. Husar
*Assistant Examiner*—Donald S. Holland
*Attorney, Agent, or Firm*—Diller, Ramik & Wight

[57] ABSTRACT

A sewage pump immersible in a conveyed medium and including an electric motor and a pump member connected therewith with there being also a suction opening. The sewage pump has comminuting devices arranged no further downstream than in the region of the suction opening for comminuting sucked-in admixtures. A principal feature of the sewage pump is that elements selectively of the retaining and repelling type are provided in combination with the comminuting devices for acting on the suction of the pump member to counteract the suction flow.

28 Claims, 8 Drawing Figures

FIG. 1
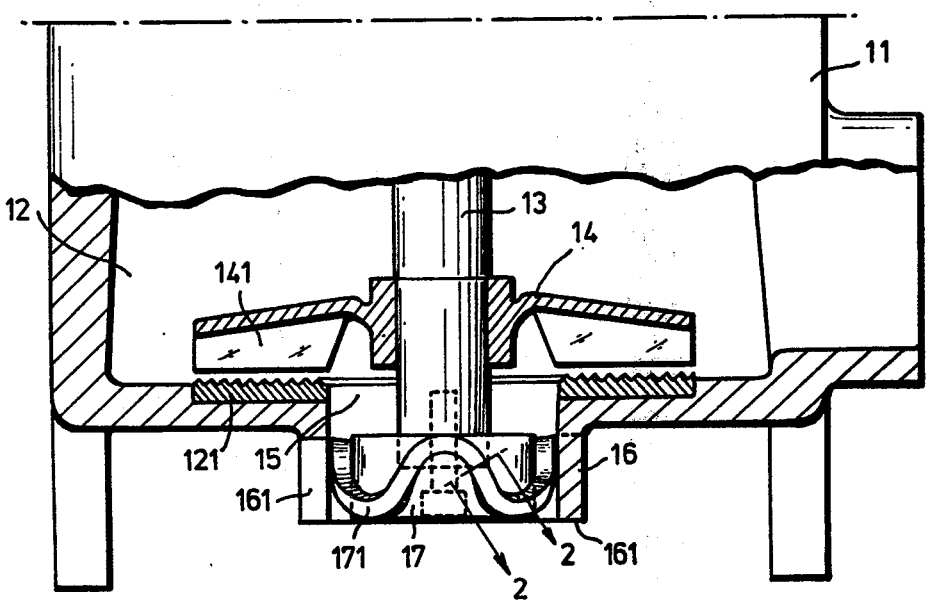
FIG. 2
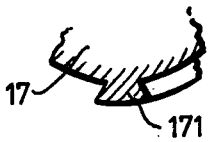
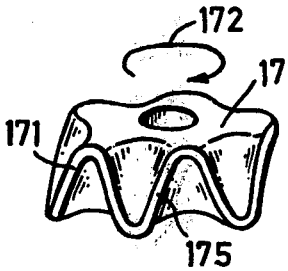
FIG. 4
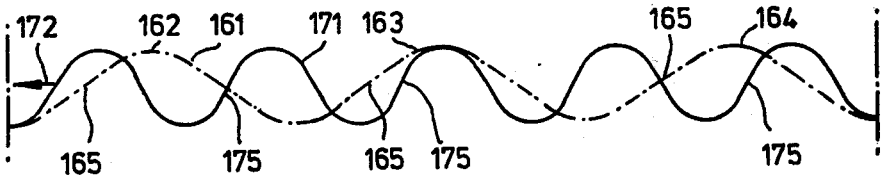
FIG. 3

SUCTION PUMP WITH ROTATABLE FLOW RETAINING AND REPELLING ELEMENT

BRIEF SUMMARY OF THE INVENTION

This invention relates to sewage pumps, and especially to pump assemblages which are formed from an electric motor and a pump connected therewith, are submersible in the conveyed medium and are intended as what are called faeces pumps for conveying sewage.

Since as a rule sewage contains a series of admixtures, such as fibrous materials, vegetable components, lumps of matter, textiles and the like, which cannot readily be conveyed by the pumps or which render orderly conveying difficult, many proposals have already been made for rendering possible or facilitating conveying. Among these proposals there are especially those by which the substances mixed with the conveyed medium are comminuted before entry into the pump and above all into the region of its conveying elements, and in fact are comminuted to such extent that conveying by the pump becomes possible without difficulty.

To this end sewage pumps have been proposed with the most various kinds of comminuting elements, some of which can be formed directly in the region of the suction opening as blades which are fixed or rotate with the pump wheel or as shearing elements in the form of fixed and rotating cutting edges and cutting fins, or as independent comminuting units driven by the pump shaft can be placed before the suction opening.

Such comminuting elements or units considerably increase the power consumption of the pumps. Therefore the invention has the purpose primarily of producing a sewage pump provided with comminuting devices which makes a low drive power suffice, with high comminuting performance. The invention furthermore has the purpose of producing a sewage pump provided with comminuting devices in which stoppages of the suction opening, such as can easily occur in the known pumps when larger textile pieces, sacks or similar fibrous admixtures are sucked in, are avoided with maximum certainty.

In sewage pumps of the initially stated kind, especially in the form of a pump assemblage formed from an electric motor and a pump connected therewith, which assemblage is submersible in the conveyed medium and possesses comminuting devices arranged in the vicinity of or before the suction opening which comminute sucked-in admixtures, this problem can be solved in accordance with the invention in that in combination with the comminuting elements there are provided retaining or repelling elements acting upon the admixtures which counteract the suction of the conveying pump and prevent stoppage of the suction opening. These retaining or repelling elements should be so formed that they are effective only briefly at time intervals. Here the formation can be effected so that with each comminuting element, such as cutting edge, cutting fin, blade or the like there is associated a repelling element, so that after every cutting of the admixtures fed to the comminuting elements under the influence of the suction effect of the conveyed medium there occurs a forcing back of these admixtures out of the region of the comminuting elements. Thus the feed of the admixtures to the comminuting elements takes place intermittently, which may possibly also be achieved due to the fact that the retaining or repelling elements are formed as elements for the generation of a pulsating suction flow.

In one preferred form of embodiment of the present invention, the comminuting device, which can be formed as a construction unit which can be placed before the suction opening, is formed from a cylindrical tube piece attachable or attached to the suction opening, the free edge of which tube piece is profiled in the axial direction and preferably made in undulatory or saw-tooth form in development, while into this tube piece there extends a fitting or insert piece which rotates with the pump shaft and possesses on its periphery adjoining the tube wall a profiling adapted to the end profile of the tube piece, at least in the form of a cutting edge or fin protruding to the tube wall. This cutting edge or fin on the periphery of the fitting piece can likewise be made in undulatory or saw-tooth form, with the undulations of the cutting edges or fins of the fitting piece corresponding to or somewhat greater than the undulations at the free end of the tube piece, in amplitude. It is advisable that the number of the undulations at the end of the tube piece should differ from that of the undulations of the cutting edges on the fitting piece. Here the number of the undulations on the fitting piece should be greater than the number of the undulations on the tube end. A ratio of 3 to 2 or 5 to 3 has proved advantageous for these numbers of undulations.

A cylindrical formation of the tube piece is expedient above all when it is to be made possible for the fitting or insert piece to be adjustable in the axial direction in relation to the tube piece in order that an adaptation may be made between the profiles of the edge of the tube piece on the one hand and the cutting edge or fin of the insert piece on the other. However such a formation can have the result that both parts must be replaced after only comparatively slight wear, if a good adaptation must be guaranteed for a good comminution performance.

These difficulties can be avoided according to a further feature of the invention in that the tube piece is of conical formation, at least on its surface co-operating with the insert piece, so that the interval of the co-operating surfaces is variable by an axial displacement of one of these parts in relation to the other. In this case one can advantageously make at least one of these two parts displaceable under the influence of spring force towards the other, in order to achieve the object that the two parts constantly rest with slight pressure against one another.

In the design respect in these cases again manifold forms of embodiment are possible. Thus by way of example the tube piece can be made with its conical part tapering outwards. However the tube piece can also be made with its conical part widening outwards. In both cases the tube piece can protrude outwards from the suction opening, that is to say precede this opening. It may however also be expedient to cause the tube piece to protrude inwards from the suction opening into the pump chamber. Then in this case the tube piece can advantageously protrude into the free space present in many cases in the pump chamber between the hub of the pump wheel and the inner edges of its vanes. Thus it is made possible if desired to form the hub itself as insert piece, at least over a part of its length. Such a formation with tube piece protruding inwards into the pump chamber is advantageous especially when working with a closed pump wheel and not an open one.

Furthermore it is possible if desired to permit the tube piece to protrude both outwards and inwards into the pump chamber, which can be expedient not only in the case of conical formation but also in the case of cylindrical formation of the tube piece. Then the tube piece can be profiled both on the outwardly and on the inwardly projecting edge. The conicity of the tube piece can also vary over its entire length, and especially towards both ends, and then it can be expedient to make the insert piece in at least two parts. Finally, the profiling of the tube piece may extend from its one edge at maximum over the whole length, in which case then the conicity is also expediently made constant over the whole length of the tube piece.

The invention will be explained in greater detail hereinafter by reference to a preferred form of embodiment of the invention which is represented diagrammatically, with certain possible modifications, with the parts essential to understanding, in the accompanying drawings.

BRIEF DESCRIPTION OF THE DRAWINGS

FIG. 1 shows the foot part of a submersible sewage pump assemblage with a partial section through the pump chamber, FIG. 2 shows a detail in a section approximately along the line 2—2 in FIG. 1, FIG. 3 shows a diagrammatic development for the one part of the profile at the end of the suction tube and for the other of the course of the cutting edge on the fitting or insert piece, FIG. 4 shows the insert piece in a preferred form of embodiment, in perspective representation, with five undulations according to FIG. 3.

DETAILED DESCRIPTION

Figure 5:
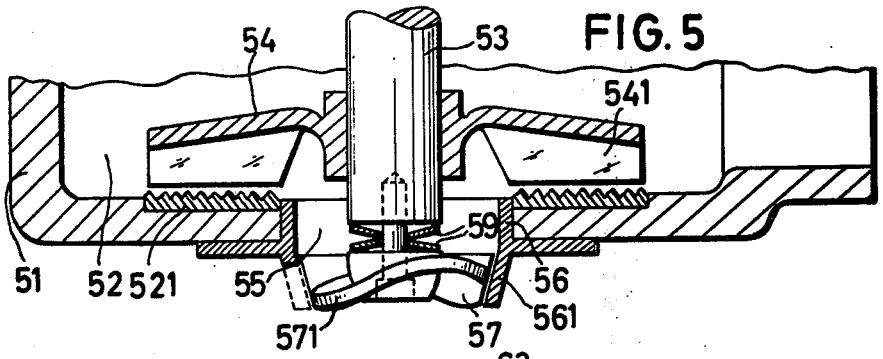
FIG. 5 shows a modified form of embodiment having a comminuting device with conical, outwardly extending tube piece.

In the drawings, the pump assemblage according to FIG. 1, which can consist of an electric motor and a pump coupled therewith which are accommodated in one common housing 11, possesses in its under part a pump chamber 12 into which the motor shaft 13 protrudes as pump shaft. On this shaft 13 the pump wheel 14 is arranged which is situated with the free edges of its vanes 141 at a short distance above a spiral or rubbing plate 121 arranged in the bottom of the pump chamber 12, which plate surrounds the suction opening 15.

A tube piece 16 is attached as part of the comminuting device according to the invention to the suction opening 15. Into this tube piece 16 an insert piece 17 is fitted which is provided on its periphery with an undulatory fin 171 which reaches as far as the internal periphery of the tube piece 16. The insert or fitting piece 17 is placed upon an extensions of the motor/pump shaft 13 and rotates therewith. The free edge 161 of the tube piece 16 possesses an undulatory profile in development. The two profiles, namely that of the tube piece 161 and that of the fin 171, are represented diagrammatically in development in FIG. 3. Here the profile of the fin 171 is indicated by the solid line and the end profile of the tube piece 161 by the dot-and-dash line.

When the pump is running a relative displacement constantly takes place between the end edge 161 of the tube 16 and the fin 171 of the insert piece 17. During the rotation of the insert piece 17, as a result of the displacement of the undulatory profiles in relation to one another, passage openings for the conveyed medium are constantly cleared and covered over again. Thus the flow through the wave troughs 162, 163, 164 of the profile at the end of the tube 16, which are to be regarded as entry openings, constantly fluctuates according to the passage cross-section cleared by the undulatory fin 171 on the insert piece 17. The admixtures are here sucked into the formed passage openings by the suction effect of the pump. In other words, as the concave undersurface of each cutting fin 171 moves past an area of the stationary profile 16 between entry openings the admixture there beneath cannot escape and is progressively repelled until the next entry opening is reached. Then as soon as the rising flank 175, which is forward in the direction of rotation (arrow 172), of the undulatory cutting fin 171 runs past the edge 165 of the stationary profile 16, the parts of the admixtures sucked into the passage opening are cut off. Only slight cutting forces are necessary for this purpose, since the inclination of the mutually engaging cutting edges in relation to one another is slight. The following descending flank of the undulatory cutting fin 171 then, before it again clears the passage opening, presses the forward edge of the following admixture piece at least to a slight extent out of the immediate region of the cutting edge. Thus there is a constant alternation between suction, cutting off and possibly pressing away, and a renewed suction, cutting and so forth, while at the same time a constant opening and closure of the passage openings takes place. Stoppages of the passage openings are effectively prevented by the thereby occurring pulsating flow. The pressing away of the sucked-in parts and the generation of a pulsating flow are favoured, as indicated in prespective in FIG. 4, by the fact that the basic body of the insert piece 17 as a whole receives a profiling which is adapted to the undulatory profile of the cutting fin. FIG. 4 shows such an insert piece having five undulations in accordance with the example according to FIG. 3, in perspective representation.

In the form of embodiment of a pump assemblage as illustrated in FIG. 5, which can consist in known manner of an electric motor and a pump coupled therewith which are arranged in a common housing 51, in known manner the motor shaft 53, as pump shaft on which the pump wheel 54 is arranged, protrudes into the pump chamber 52. The free edges of the vanes 541 of the pump wheel 54 here move at a short distance above a spiral or rubbing plate 521 which is arranged in the bottom of the pump chamber 52 and surrounds the suction opening 55 of the pump housing.

Into the suction opening 55 a tube piece 56 is inserted which is made conically tapering outwards in its part 561 protruding downwards beyond the bottom of the pump chamber. This conical edge 561 of the tube piece 56 is profiled in undulatory form in development, and upon the end of the motor shaft 53 extending through the pump wheel 54 there is set an insert piece 57, of conical overall outline, with an edge 571 of undulatory profile, the conicity of which is adapted to the conicity of the tube piece 56 and 561. Between insert piece 57 and shaft end 53 dished springs 59 are interposed so that the insert piece 57 is kept in abutment on the inner wall of the tube piece 56 by spring pressure.

Figure 6:
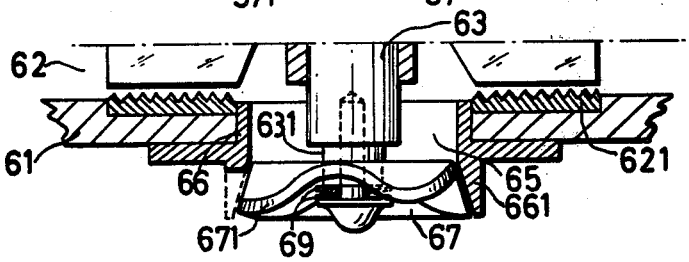
FIG. 6 shows a further modified form of embodiment with conical tube piece.

In the form of embodiment according to FIG. 6 a modification is effected in comparison with the form of embodiment according to FIG. 5 only in as much as the tube piece 66 arranged in the bottom of the pump chamber 62 of the housing 61 and seated in the suction opening 65 surrounded by a spiral plate 621 widens conically outwards in its outwardly protruding part 661, on its inner side. The insert piece 67 with its undulatory edge 671, seated on the lower end of the motor shaft 63, is correspondingly of conical formation. The insert piece is displaceable in the axial direction on an extension piece of the shaft 631, and is pressed against the conical tube piece 661 by dished springs 69.

Figure 7:
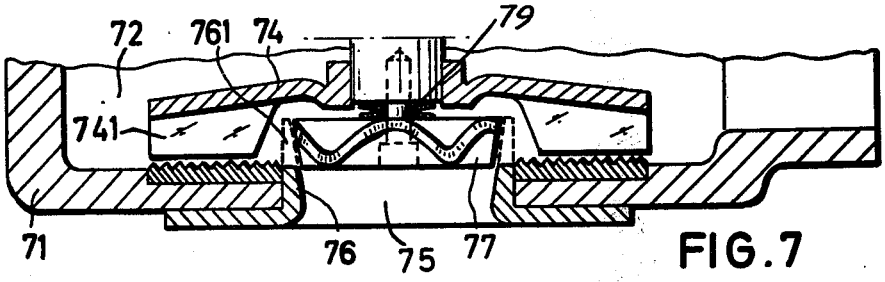
FIG. 7 shows a third possible modification with tube piece protruding inwards into the pump chamber.

In the form of embodiment according to FIG. 7 the tube piece 76 inserted into the suction opening 75 situated in the bottom of the housing 71 is drawn with its profiled undulatory edge 761 inwards into the pump chamber 72. The profiled edge 761 extends into the space which remains free on the inner periphery of the vanes 741 of the pump wheel 74. The insert piece 77, the conicity of which is adapted to the conicity of the tube piece 76, largely corresponds to the insert piece 57 in FIG. 5 and is pressed by dished springs 79 against the tube piece 76.

Figure 8:
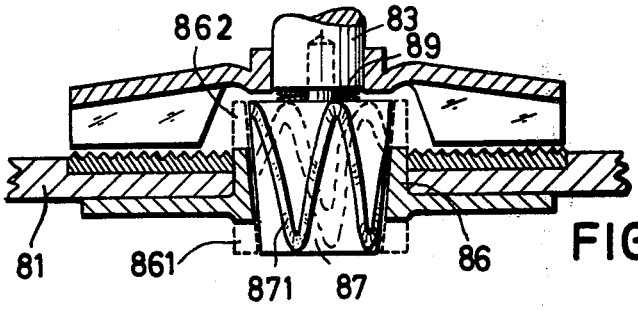
FIG. 8 shows a fourth form of modification in which the tube piece protrudes both outwards and inwards into the pump chamber.

Finally in FIG. 8 an embodiment possibility is illustrated in which the tube piece 86 inserted into the housing bottom 81 possesses both an outwardly protruding part 861 and an inwardly protruding part 862. The tube piece 86 possesses a constant conicity over its whole length, but this conicity could also vary over the whole length of the tube. The two edges 861 and 862 protruding outwards and inwards beyond the housing bottom are profiled as in the previous examples. An insert piece 87 with an undulatory profiling 871 carried by the end of the motor shaft 83 with interposition of springs 89 is seated in the tube piece 86, the profiling 871 extending from the outer edge of the tube part 861 to the inner edge of the tube part 862. Naturally the profiling of the insert piece could be provided only in the region of the profiling 861 of the tube piece 86 and of the profiling 862, so that a profile-free part would remain between the two profilings of the insert piece 87.

What I claim is:

1. A suction pump assembly comprising an electric motor, a pump and a housing; a suction opening in said housing, and comminuting means disposed contiguous said suction opening for comminuting sucked-in admixtures flowing through said suction opening, said comminuting means including rotatable means for alternately retaining and repelling the flow of the admixtures through the suction opening and counter-acting the suction of said pump.

2. The suction pump assembly as defined in claim 1 wherein said retaining and repelling means become effective only briefly at time intervals by reason of their characteristics.

3. The suction pump assembly as defined in claim 1 wherein said pump has a shaft, and with said shaft is associated said retaining and repelling means.

4. The suction pump assembly as defined in claim 1 wherein said retaining and repelling means generate a pulsating suction flow.

5. The suction pump assembly as defined in claim 1 wherein said suction opening is defined by a cylindrical tube piece, said tube piece including a wall having a free edge profiled in an axial direction, said retaining and repelling means having a portion extending in said tube piece and being carried by a rotatable shaft of said pump, said portion of the retaining and repelling means having a periphery adjacent said tube piece wall profiled generally to the free edge profile of said portion of the tube piece, and said retaining and repelling means being in the form of a peripheral fin projecting toward said tube piece wall.

6. The suction pump assembly as defined in claim 1 wherein said retaining and repelling means includes a circumferentially extending axially undulating element.

7. The suction pump assembly as defined in claim 1 wherein said retaining and repelling means includes a circumferentially extending axially undulating element generally bounding an interior surface of said suction opening.

8. The suction pump assembly as defined in claim 1 wherein said retaining and repelling means includes a circumferentially extending axially undulating element which defines with a wall of said suction opening a radial flow path for said admixture.

9. The suction pump assembly as defined in claim 1 wherein said retaining and repelling means includes a circumferentially extending axially undulating element carried by a shaft of said pump, and said shaft pump further carries a plurality of vanes.

10. The suction pump assembly as defined in claim 9 wherein part of said comminuting means is disposed in generally surrounding relationship to said retaining and repelling means.

11. The suction pump assembly as defined in claim 5 wherein the profile at the free edge of the tube piece wall is of a saw-tooth form in development.

12. The suction pump assembly as defined in claim 5 wherein said tube piece wall protrudes outwardly of said housing.

13. The suction pump assembly as defined in claim 5 wherein said pump includes a shaft carrying a hub and a plurality of vanes, and said tube piece wall protrudes into a gap between said hub and vanes.

14. The suction pump assembly as defined in claim 5 wherein said housing defines a pump chamber, and said tube piece wall protrudes both inward and outward relative to said pump chamber.

15. The suction pump assembly as defined in claim 5 wherein said pump includes a shaft carrying a plurality of vanes, and said shaft further carries a portion of said retaining and repelling means.

16. The suction pump assembly as defined in claim 5 wherein said housing defines a pump chamber, and said tube piece wall protrudes from said suction opening into said pump chamber.

17. The suction pump assembly as defined in claim 16 wherein said pump includes vanes carried by a shaft and said tube piece wall projects into an area inboard of said vanes.

18. The suction pump assembly as defined in claim 5 wherein said tube piece wall is of a conical formation and the distance between said tube piece wall and said peripheral fin is variable.

19. The suction pump assembly as defined in claim 18 including means for biasing a portion of said retaining and repelling means toward said tube piece wall.

20. The suction pump assembly as defined in claim 18 wherein said tube piece wall is conical.

21. The suction pump assembly as defined in claim 18 wherein said tube piece wall is conical and widens in a direction outwardly of said housing.

22. The suction pump assembly as defined in claim 5 wherein the profile at the free edge of the tube piece wall is, undulatory in development.

23. The suction pump assembly as defined in claim 22 wherein said peripheral fin is of a saw-tooth form in development.

24. The suction pump assembly as defined in claim 22 wherein said peripheral fin is of an undulatory development.

25. The suction pump assembly as defined in claim 24 wherein the undulations of said peripheral fin correspond approximately in amplitude to the undulations of said free edge.

26. The suction pump assembly as defined in claim 24 wherein the undulations of said free edge differ in number from the undulations of said peripheral fin.

27. The suction pump assembly as defined in claim 26 wherein the number of the undulations of said peripheral fin is greater than the number of the undulations of said tube piece free edge.

28. The suction pump assembly as defined in claim 27 wherein the number of the undulations on the peripheral fin is in the ratio of about 3:2 to 5:3 to the number of the undulations at the free edge.

* * * * *